US005584326A

United States Patent [19]

Galli

[11] Patent Number: 5,584,326

[45] Date of Patent: Dec. 17, 1996

[54] COMPACT APPARATUS FOR THE STORAGE, DELIVERY AND MIXING OF FLUID SUBSTANCES

[75] Inventor: Dino Galli, Como, Italy

[73] Assignee: I.A.S. Industrial Automation Systems S.A.S.di Dino Galli & C., Como, Italy

[21] Appl. No.: 347,153

[22] Filed: Nov. 22, 1994

[30] Foreign Application Priority Data

Nov. 22, 1993 [IT] Italy ..... MI93A2470

[51] Int. Cl.[6] ..... B65B 1/30; B65B 3/26

[52] U.S. Cl. ..... 141/83; 141/104; 141/157; 141/231; 366/605; 366/286

[58] Field of Search ..... 141/83, 103, 104, 141/105, 85, 89, 129, 156, 157, 165, 167, 168, 170, 171, 172, 231; 222/394, 144.5; 417/118; 366/605, 286

[56] References Cited

U.S. PATENT DOCUMENTS

| | | | |
|---|---|---|---|
| 1,154,665 | 9/1915 | Small | 141/231 |
| 3,994,117 | 11/1976 | Kinney | 141/172 |
| 4,518,021 | 5/1985 | Copas et al. | 141/172 |
| 4,913,198 | 4/1990 | Hayahara et al. | 141/103 |
| 5,017,017 | 5/1991 | Godat et al. | 366/605 |
| 5,123,569 | 6/1992 | Lindner | 222/394 |
| 5,156,193 | 10/1992 | Baroffato et al. | 141/103 |
| 5,163,484 | 11/1992 | Howlett et al. | 141/103 |
| 5,267,790 | 12/1993 | Sutherland et al. | 366/286 |

FOREIGN PATENT DOCUMENTS

| | | |
|---|---|---|
| 0176140 | 2/1986 | European Pat. Off. . |
| 0427497 | 5/1991 | European Pat. Off. . |
| 2115784 | 9/1983 | United Kingdom . |
| WO86/02320 | 4/1986 | WIPO . |

*Primary Examiner*—David J. Walczak
*Assistant Examiner*—Steven O. Douglas
*Attorney, Agent, or Firm*—Young & Thompson

[57] ABSTRACT

Apparatus for the storage, delivery and mixing of fluid substances. The apparatus consists of a compact, pre-assembled, movable operative unit, enabling the storage of a large number of substances and the management of a large number of delivery points in an extremely small area. The apparatus comprises a conveyor and at least one set of storage tanks on a support frame along one or both sides of the conveyor; pumping device and a multi-valve delivery head are provided for supplying metered quantities of the substances to be mixed, in a container positioned on a conveyor section above an electronic scale. The electronic scales and corresponding section of the conveyor are laterally translatable on a vertically movable shelf to selectively position a mixing container under a multi-valve unit according to an operative program governed by a programmable control unit; a mixer is provided at the end of the conveyor which is opposite the multi-valve unit.

20 Claims, 4 Drawing Sheets

COMPACT APPARATUS FOR THE STORAGE, DELIVERY AND MIXING OF FLUID SUBSTANCES

BACKGROUND OF THE INVENTION

The present invention relates to an automatic apparatus in the form of a pre-assembled programmable operative unit for the storage, delivery and mixing of metered quantities of fluid substances, used for example during the preparation of dyeing baths, dyeing substances and the like, by means of which it is possible to group together and manage in a small area, a plurality of storage tanks and the associated means for supplying metered quantities of the various substances which must be mixed, under the control of a logic processing unit.

During the preparation of mixtures from fluid substances, for example during the preparation of dyes for the textile industry, paints and auxiliary agents in general, the individual substances or individual ingredients to be mixed are contained in respective storage tanks from which they are taken in metered quantities which are controlled by means of weighing operations.

For this purpose, various apparatuses have been developed, as a result of which it is possible to deliver automatically and mix metered quantities of the various substances, removing them in a controlled manner from the respective storage containers. The documents U.S. Pat. No. 4,526,215, EP-A-0,344,521, EP-A-0,537,434 describe some examples of automatic metering apparatuses which can be used in different application sectors.

In particular, EP-A-0,344,521 describes a metering and mixing plant comprising a plurality of tanks arranged at a suitable distance from one another on a fixed support structure which extends along a path for a carriage provided with a container into which in each case the metered quantities of the individual substances are poured, said substances being subsequently introduced into a mixer located underneath the path of the carriage supporting the container. Each tank is provided moreover with a screw feeder which discharges said substances into an auxiliary container tiltably supported by a weighing device, underneath which the container is arranged in order to receive the substances to be mixed. This solution requires on-site assembly of the entire plant which, once installed, cannot be displaced or removed; moreover, said plant is extremely complicated and difficult to manage and cannot be used in those applications where extremely precise doses are required, both owing to the unreliable nature of the screw metering system and on account of the possible accumulation of errors of the various weighing devices associated with the individual tanks. Moreover, the operating cycle of the entire plant is difficult to manage since residual quantities of the substances to be mixed could remain in the various weighing containers, as well as in the actual movable receiving container, thus altering the mixing conditions.

The document U.S. Pat. No. 4,526,215 illustrates an apparatus for the metering and mixing of fluid substances, in particular paints, comprising a fixed rack provided with a plurality of storage containers, each of which is provided with a delivery valve suitably operated by a support carriage for a receiving container, movable in front of the rack. A weighing scale is mounted on the carriage and is connected to a processing unit. Each container is provided moreover with a respective stirrer which performs mixing after the delivery of each component. This solution also involves installation in a fixed manner, being extremely complicated and costly and unsuitable for applications where it is required to perform the metering of variable quantities of the substances to be mixed, for example for the filling of drums with a capacity of between 10 or 20 and a few hundred litres.

An apparatus for the delivery and metering of fluid substances is also known from the document EP-A-0,537,434 and comprises a plurality of tanks mounted on a bridge structure fixed to the floor. Each container is provided with a delivery head aligned along a travel path for a carriage transporting a receiving container located on weighing scales controlled by a logic processing unit. When the receiving container is completely full, the container must be removed and transferred into another working station for the mixing stage. Although the aim of this patent is to provide an automatic apparatus of limited dimensions, suitable for small or medium-size users, it is still bulky from a structural point of view and also requires long and complicated assembly and set-up operations on-site before it can be used.

In general, the known apparatuses involve the fixed installation of the various components, which must be performed on the actual site where the apparatus is to be used and which does not allow any subsequent modification or displacement of the entire apparatus so that it can be adapted to new or variable requirements as regards use of the apparatus itself. All this requires moreover the separate dispatch of the various components, their assembly on-site and the need to carry out time-consuming verification and setting up of the apparatus, following installation.

A scope of the present invention is to provide an apparatus for the delivery and metering of fluid substances to be mixed, particularly suitable for the preparation of dyeing substances, for example for the textile industry or for other applications, said apparatus having an extremely compact structure as a result of which it is possible to perform the entire mixture preparation cycle, from the delivery of metered quantities of the individual substances to mixing thereof, in a short time restricting the entire assembly to an extremely small area which can be easily monitored or accessed by an operator.

A further scope of the present invention is to provide an apparatus as described above, which can be easily transported and installed in a perfectly operational, ready-assembled condition, i.e. which can be displaced subsequently so as to adapt it to the various requirements of a user, without having to perform on-site disassembly or reassembly of the apparatus.

A further scope of the present invention is to provide an apparatus of the above-mentioned kind, provided with a metering system comprising a single metering unit which can be selectively connected to a plurality of storage tanks grouped together in a compact manner, so as to ensure precise metering of the various substances to be mixed, with reliable and safe operating conditions in any working environment.

SUMMARY OF THE INVENTION

More generally, according to the invention an apparatus for the delivery and metering of fluid substances to be mixed, in particular dyeing substances, comprises a support structure for a plurality of tanks for storing the substances to be mixed, an electronic weighing scale and a plurality of delivery valves which can be selectively connected to the storage tanks via pumping devices for delivering said substances into open-top mixing containers in a programmed manner by a logic control unit; and means for conveying the mixing containers along a conveying path and towards a mixing device, said delivery valves being grouped together in a single delivery unit arranged at one end of said conveying path which is opposite to that of the mixing device; said storage tanks being grouped together along at least one side of said path for accumulating the mixing containers, between the aforementioned delivery unit and the mixing device; and in that the assembly consisting of the metering unit, the weighing scale, the tanks for storing the substances to be mixed, the pumping devices, the means for conveying the mixing containers, and the mixing device are provided on a single support frame in the form of a pre-assembled movable operating unit.

Thus, the apparatus may be dispatched and supplied entirely pre-assembled, already factory-tested and fully operational, requiring only the power connections on-site; moreover it is possible to remove the apparatus and displace it easily inside the same environment or into a different working environment so that it can be adapted to the varying operational requirements of the user. The removal and/or displacement of the apparatus may likewise be performed extremely easily and quickly by simply disconnecting the power connections and providing the support frame of the apparatus with suitable wheels enabling the latter to be moved.

The arrangement of the various storage tanks along the actual accumulation conveyor, the arrangement of a single multiple valve delivery-head and the mixing device at the opposite ends of the conveying path, as well as the lateral translation movement of the weighing scale and the conveying section associated therewith, enable the entire apparatus to be constructed in a compact manner on a single movable frame having dimensions suitable for transportation with a normal container and such that it is possible to manage a large number of delivery points for the substances to be mixed, whilst ensuring that the entire apparatus has extremely limited dimensions and occupies a small amount of space.

BRIEF DESCRIPTION OF THE DRAWING

The apparatus for the delivery, metering and mixing of fluid substances according to the invention, will be described hereinbelow with reference to the accompanying drawings, in which.

DETAILED DESCRIPTION OF THE INVENTION

Figure 1:
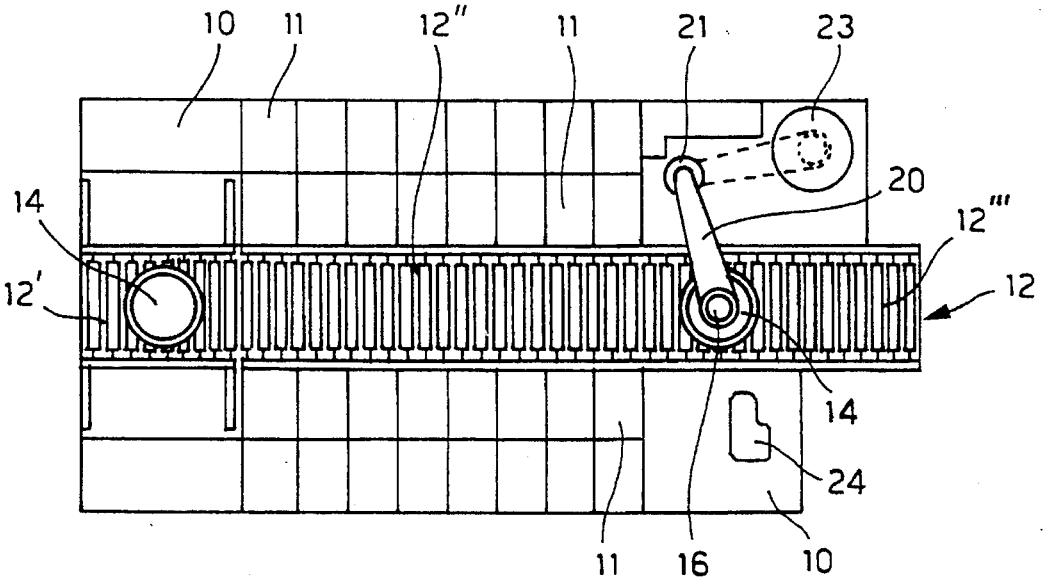
FIG. 1 is a top view of the apparatus with the upper part of the support frame partially removed.

As shown in FIGS. 1 to 6, the apparatus substantially comprises a support frame 10 for a plurality of main tanks 11 suitable for the storage of the various fluid substances to be mixed. The main tanks 11, in the example shown, are grouped together alongside one another in a double row on either side of a longitudinal path 12 for conveying of the mixing containers 14, consisting for example of a conveyor with motor-driven rollers having several independent conveyor sections, as indicated by 12', 12" and 12'''; the section 12' is located at one end of the apparatus in a position underneath a multi-valve unit 15 for the delivery of metered quantities of the substances to be mixed, followed by the middle section 12" for accumulation of the containers 14, and the section 12''' at the other end of the apparatus where a suitable mixing device 16 is provided.

Figure 2:
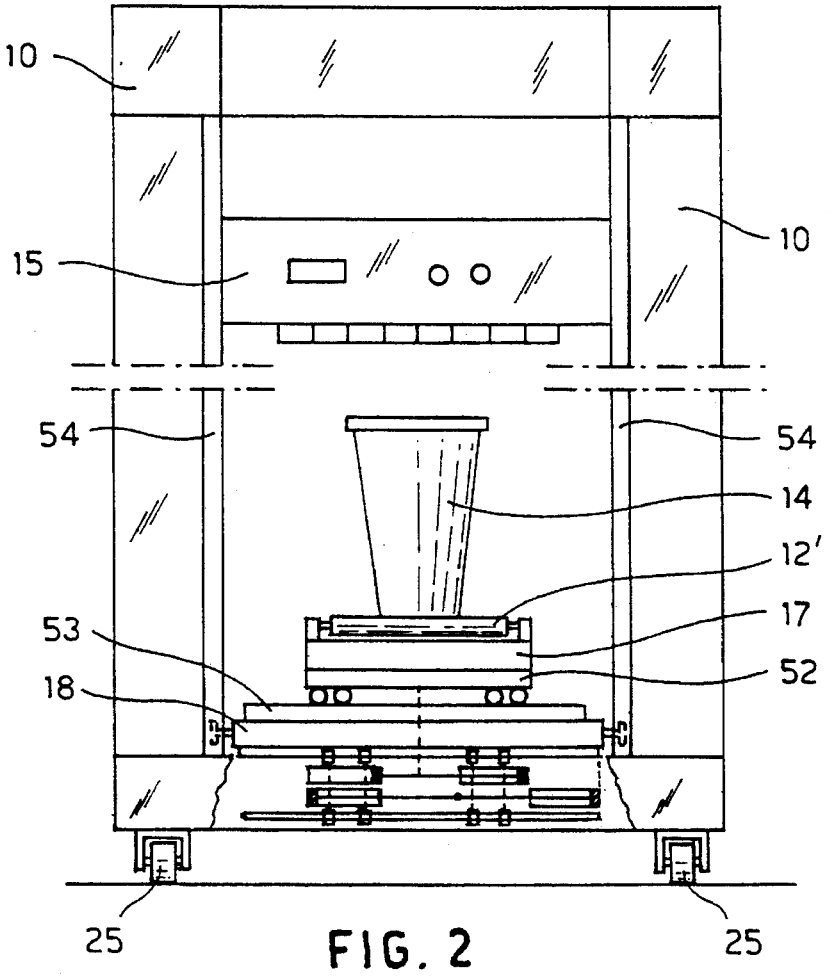
FIG. 2 is a view from the delivery-unit end.
Figure 3:
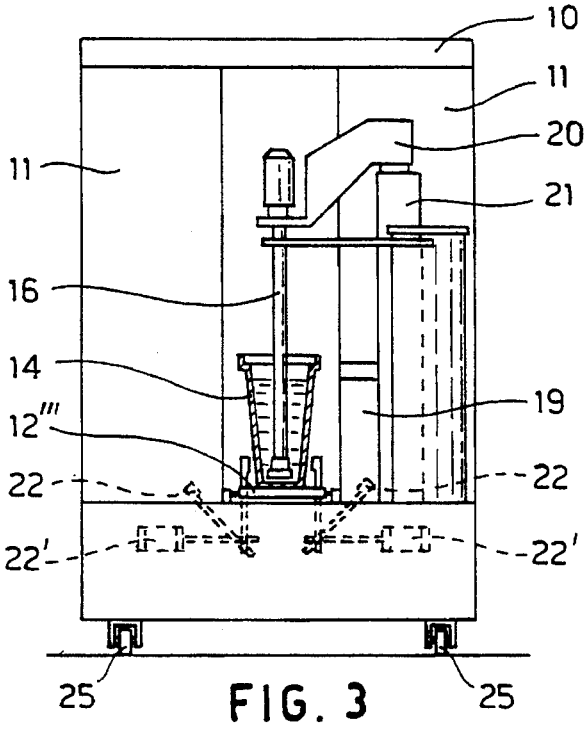
FIG. 3 is a view from the mixer end.

As shown in FIG. 2 and as explained below, the first section 12' of the conveyor, also called the weighing section, is located on an electronic weighing scale 17 for weighing metered quantities of the various substances to be mixed, which scale is monitored and controlled via a programmable processing unit (CPU). The scale 17 and the corresponding section 12' of the conveyor are laterally movable, in a transverse direction with respect to the conveying path 12, in order to selectively position a mixing container 14 underneath one or more prechosen valves of the multi-valve delivery head 15. The scale 17 and the conveyor section 12' are moreover arranged on a support shelf 18 which is vertically movable between a lowered position, shown in FIG. 2, and a raised position with the mixing container 14, in the vicinity of the multi-valve head 15 for receiving the various components to be mixed.

Figure 6:
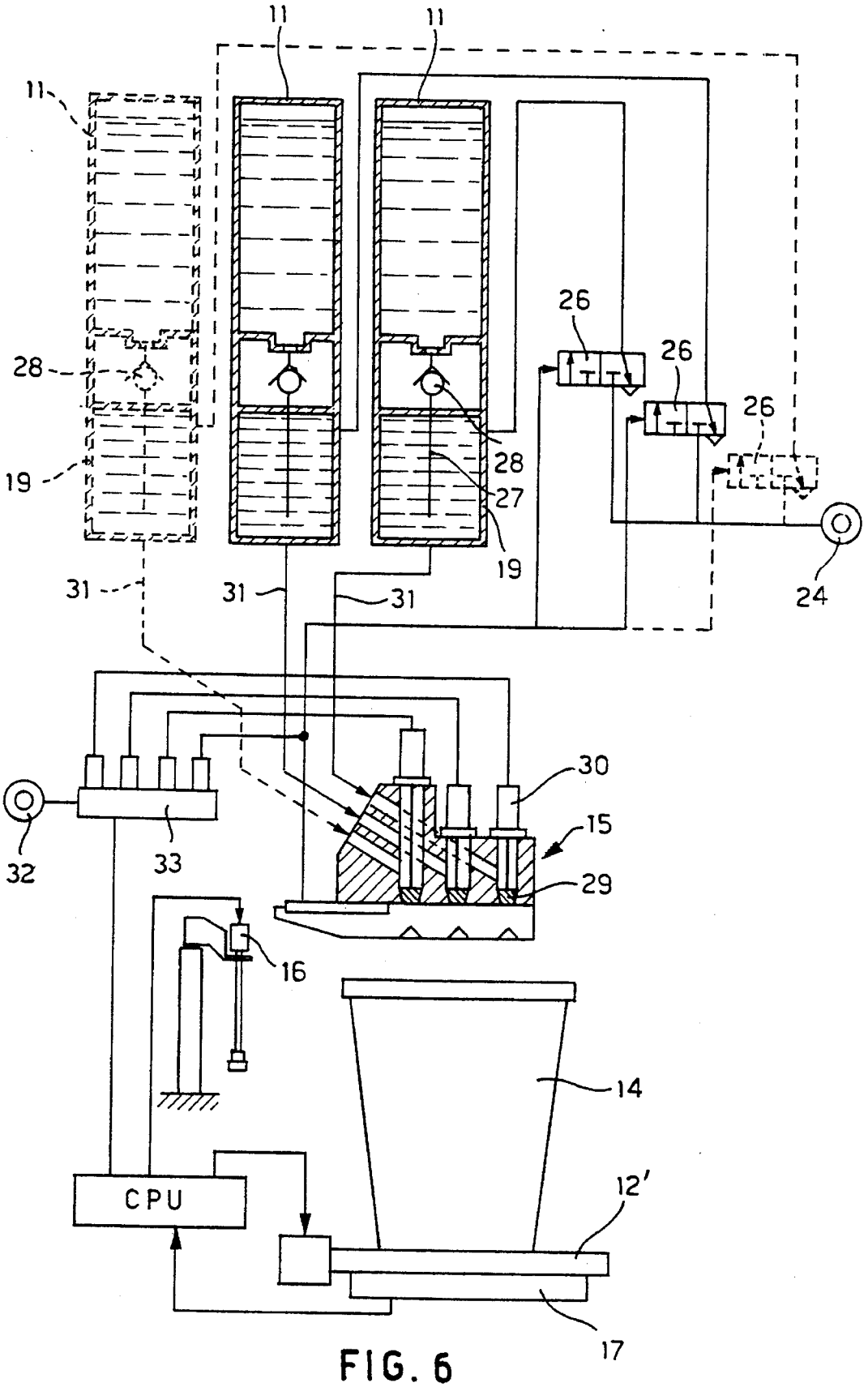
FIG. 6 is a first operational diagram of a possible embodiment of the apparatus according to the invention.

The supply of the individual substances to be mixed, from the storage tanks 11 to the metering unit 14, may be performed in any known manner by means of suitable pneumatic or mechanical pumping and supply means, for example by means of pumps or the like; preferably in the solution shown in FIG. 6, said pumping means comprise for each main tank 11, a pressurisable auxiliary tank 19 directly connected to the various delivery valves of the unit 15, as diagrammatically shown in FIG. 6.

The mixer 16 is in turn supported, via a rotating arm 20, by the stem of a hydraulic or pneumatic cylinder 21 located on one side of the apparatus, at the exit end for the mixing containers 14 which are transferred in each case from the accumulation section 12" to the section 12''' of the conveyor into a position underneath and axially aligned with the mixer itself; in this position the individual containers 14 which are accumulated on the middle section 12" of the conveyor, during the mixing operation are locked in position by a pair of lateral jaws 22 or similar locking members operated by respective pneumatic cylinders 22'.

The mixer support arm 20 is connected to the actuating cylinder 21 so as to rotate, via suitable actuating means, from the operating position aligned with a container 14 located underneath, as shown in continuous lines in FIG. 1, to a lateral position, as shown in broken lines again in FIG. 1, where the mixer 16 extends into a water washing tank 23; in FIG. 1, finally, 24 denotes a compressor or compressed-air source which enables the entire apparatus to operate in a completely autonomous manner.

The delivery and metering apparatus thus described therefore constitutes in its entirety a ready pre-assembled, structurally compact and operationally autonomous unit which is able to manage, in a small area, a large number of delivery points and which can be easily moved, for example by providing it with suitable wheels 25, and transported as a whole by road, rail and/or sea in a normal container with standard dimensions.

With reference to FIG. 6, a description is now given of a first operational diagram of the apparatus according to the invention.

In FIG. 6 each main tank 11 is designed to contain a large quantity of a substance to be delivered, supplying it by means of simple gravity into a suitably pressurisable auxiliary tank 19 located underneath. The auxiliary tank 19, which has a smaller capacity than that of the storage tank 11, consists of a hermetically sealed tank which can be suitably pressurised with air at a constant pressure value, controlled via a group of solenoid valves or pneumatically operated valves 26 connected to a pressurised-air source or to the compressor 24. Each main storage tank 11 is connected to the respective auxiliary tank 19 via a pipe 27 comprising a non-return valve 28.

The metering unit 15 is provided with a plurality of delivery valves 29, each operated by an associated pneumatic actuating cylinder 30; each valve is connected moreover to the bottom of a respective auxiliary tank 19 via a corresponding pipe 31. The pneumatic valves 26 for pressurisation of the auxiliary tanks 19, and pneumatic cylinders 30 for actuating the delivery valves 29, receive compressed air from a suitable source 31 supplied by the compressor, via an electropneumatic interface 33 controlled by the CPU. The CPU, as diagrammatically shown in FIG. 6, in addition to being programmed to control the delivery of metered quantities of the various substances from the individual auxiliary tanks 19, is also programmed to control the operation of the entire apparatus, in particular the three sections of the conveyor 12 and mixer 16.

The operation mode of the apparatus is briefly described as follows: the CPU is programmed according to the quantities of the various substances to be mixed and the predetermined delivery sequences. Then, a receiving container 14 is arranged at the entry point of the apparatus on section 12' of the conveyor opposite the electronic scale 17, thus commencing the operating cycle. Consequently, according to the programmed operating sequences, the CPU first commands positioning of the container 14 and opening of the delivery valves 29 which have been selected, for the required duration, thus allowing the container 14 located underneath to receive metered quantities of the various substances to be mixed, with monitoring and control of the data supplied by the scale 17 to the CPU. During delivery of each substance, the scale 17 provides an indication of the exact quantity which has been delivered; when the stage involving filling of the container 14 has terminated, the CPU registers that the delivery operations have been completed and commands the transfer of the full container from the first section 12' of the conveyor to the middle section 12" where the full containers are accumulated or remain on stand-by; the conveyor section 12" is provided with its own independent drive system for moving forward each container 14 until it stops in the vicinity of a container 14 which has been previously filled or in the region of the end section 12''' of the conveyor, between the locking jaws 22. The jaws 22 are operated via the cylinders 22' so as to hold the container 14, while the mixer 16 is raised and extracted from the washing tank 23, being then lowered inside the container 14, where it is actuated for the duration necessary to obtain thorough mixing of the various substances delivered. Since delivery of the individual substances is effected while maintaining the auxiliary tanks 19 pressurised at a constant pressure value, via the group of valves 26 controlled by the CPU, it is obvious that in this way it is possible to perform precise and accurate metering, while ensuring constant and repeatable results.

In the meantime, during the mixing stage of the substances inside the first of the containers 14 to come into position at the mixer 16, a new empty container 14 may be positioned at the entry end of the apparatus, on the conveyor section 12' and the scale 17, for a new metering and filling stage, and so on for the successive containers which gradually accumulate in the middle stand-by section of the conveyor 12 corresponding to the same zone where the tanks are situated. It is thus possible to group together all the functions of delivery, metering and mixing of the components and movement of the mixing containers in a single and independent apparatus, using the space of the middle section of the conveyor in order to accommodate the full containers and the group of storage tanks; in this way it is possible to achieve a significant saving in space as well as a simple structure and simplified operational management of the entire apparatus.

When mixing of the substances in the first filled container has been completed, the latter is conveyed away and unloaded at the opposite end of the conveyor 12 so as to be replaced with another container 14 which in the meantime has been filled by the metering unit 15. During the stage involving unloading of a container with the already mixed substances, the mixer 16 is raised and introduced again into the washing tank 23 so as to then be repositioned inside a successive container 14 which in the meantime has been positioned between the locking jaws 22.

The auxiliary tank 19 can be pressurised at a value or at several values which are predetermined. More precisely, each auxiliary tank 19 is connected to a pressurised-fluid source 24, such as for example a compressor, via a tank 34, a main pressure regulator 35, a filter 36, a pressure control unit 37, shown in detail in FIG. 8, a pressurisation valve 38 and, optionally, via a rapid-discharge valve 39. The rapid-discharge valve 39, via a branched pipe 40, enables the auxiliary tank 19 to be connected to the main tank 11 and the former to be depressurised under the control of the processing unit (CPU) which governs the entire working cycle of the apparatus.

The various valves of the multi-valve delivery head 15, those of the pneumatic circuit for pressurisation of the auxiliary tanks 19, and the various cylinders for effecting displacement of the scale 17 and the conveyor section 12' are pneumatically actuated via a group of solenoid control valves 41 connected to the compressed-air source 24 via an auxiliary tank 42, a pressure regulating valve 43 and an air distributor 44.

Figure 7:
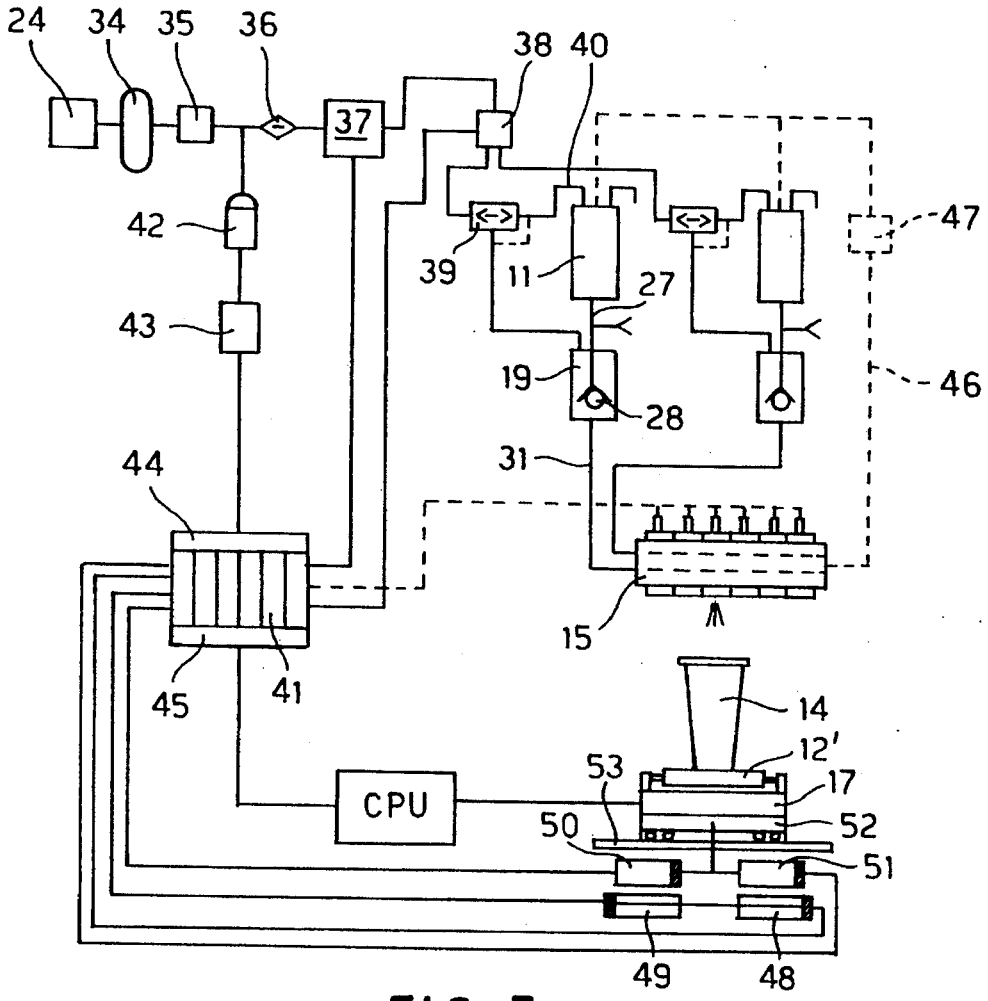
FIG. 7 is a second operational diagram of the apparatus according to the invention.

At the same time, the solenoid valves 41 are operationally connected to the electronic control unit (CPU) via a suitable interface 45. In FIG. 7, 46 also indicates in diagrammatic form a recycling circuit comprising a valve unit 47 suitably controlled by the processing unit (CPU) for the recirculation of the fluid substances from each main tank 11 to the respective auxiliary tank 19, via the delivery head 15, the valve unit 47 and again towards the tank 11 so as to avoid the formation of deposits, keeping the substance to be delivered in the required fluid state.

FIG. 7, similar to FIG. 2 of the drawings, also shows in diagrammatic form a possible system of pneumatic cylinders for effecting the lateral translation movements of the scales 17 and conveyor section 12', so as to move selectively the individual mixing containers 14 under a valve or a group of valves for programmed delivery. In the example shown, the group of actuating cylinders is supported by the shelf 18 (FIG. 2) for raising the scales and comprises a first pair of opposite cylinders 48, 49, with their respective pistons interconnected, the first cylinder 48 of which is fixed to the shelf 18 (FIG. 2), while the second cylinder 49 is fastened, in a slidable manner with respect to the shelf 18, to a second pair of opposite cylinders 50, 51, the pistons of which are connected to one another and linked to a carriage 52 supporting the scales 17; the carriage 52 in turn is slidable along transverse guides 53 supported by the movable shelf 18 (FIG. 2). By actuating in a programmed manner the various pneumatic cylinders in the correct sequence, it is possible to displace the scales 17, the conveyor section 12' and the container 14 into several predetermined positions, selectively under corresponding valves or groups of valves of the delivery head 15. It is obvious that other actuating systems or solutions are possible.

Figure 5:
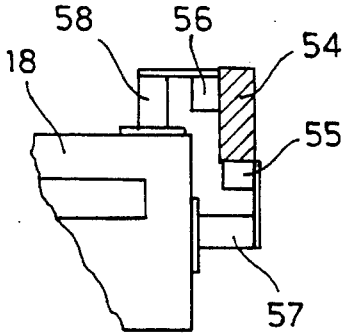
FIG. 5 is a detail showing the system for guiding the scale support shelf.
Figure 4:
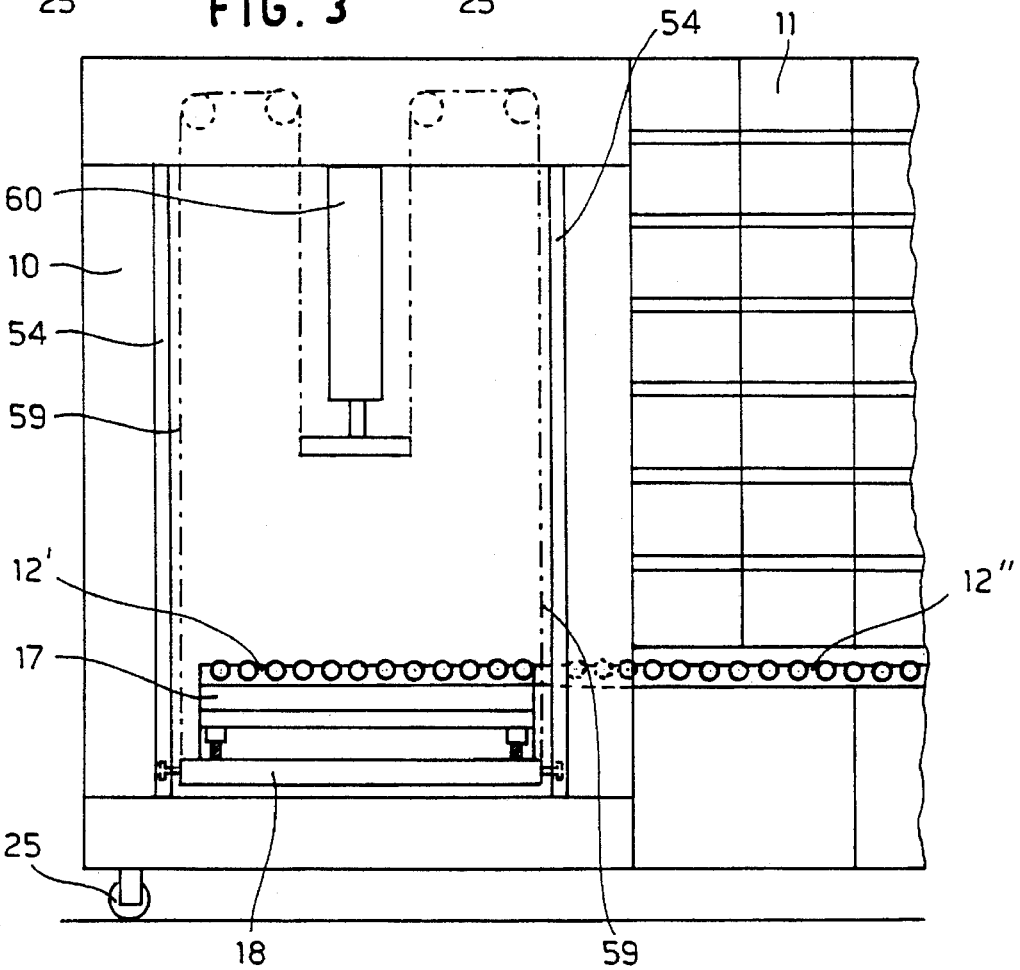
FIG. 4 is a side view, with parts removed, designed to show the raising movement of the shelf supporting the scale.

With reference now to FIGS. 4 and 5, we shall now describe a possible embodiment of the means for guiding and effecting the vertical movement of the shelf 18 supporting the scale 17 and the conveyor section 12'. As shown, the shelf 18 travels along four vertical guides 54 located at the corners of the shelf 18 which is kept centered by means of pairs of guiding rollers 55, 56 arranged on orthogonal planes of the guide 54; each roller is fixed to the shelf 18 by means of a vibration-damping support 57, 58.

The shelf 18, as shown in FIG. 4, is raised on each side by means of a cable or chain system 59 operated by a pneumatic cylinder 60 which receives pressurised air from the solenoid-valve group 41, again under the programmed control of the CPU.

Figure 8:
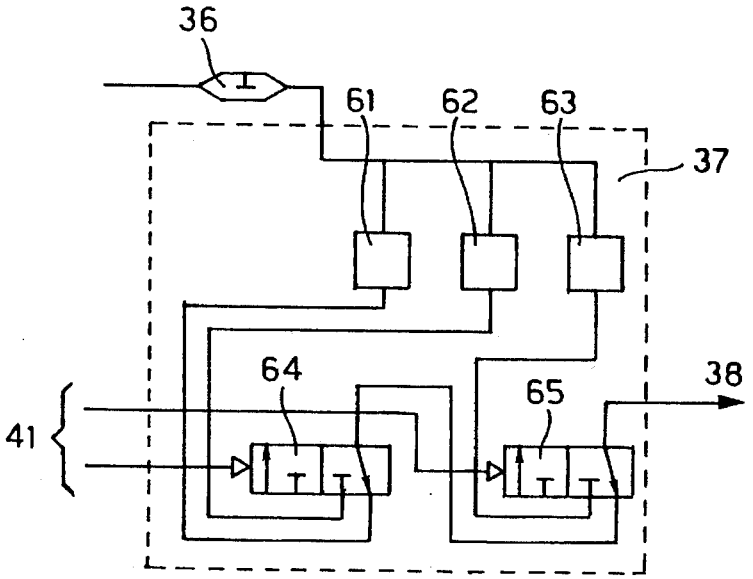
FIG. 8 is an enlarged portion of FIG. 7.

The operation mode of the apparatus shown in FIG. 7 is substantially similar to that of FIG. 6; FIG. 8 of the drawings shows a possible variant for the valve group 37 controlling pressurisation of the auxiliary tanks 19. In the above examples, the auxiliary tanks 19 were pressurised at a constant pressure value which was maintained for the entire duration of delivery of the substances. According to the embodiment of FIG. 8 it is possible to reduce substantially the delivery time of each substance and improve significantly the metering precision by operating with different pressurisation values, more specifically with a high pressurisation value during a first delivery stage, which therefore can be performed rapidly, and with a second pressurisation value, during a subsequent stage, so as to obtain precise metering. Moreover, it is possible to operate with a third pressurisation value for the auxiliary tanks 19, lower than the preceding ones, for recycling of the components in the respective storage containers.

Therefore, in the example shown in FIG. 8, the group of control valves 37 comprises three pressure regulators 61, 62 and 63 supplied by the same pressurised-air source, each designed to provide a different and progressively decreasing value for the regulated pressure.

The outputs of the regulators 61, 62 and 63 are connected, in the manner shown, to the inlets side of two pneumatic valves 64, 65 which perform the function of exchanging these three pressure values supplied to the pressurisation valve 38; one of the exchange outputs of the first valve 64 is in turn connected to one of the exchange inlet of the other valve 65. Therefore, when neither of the two valves 64 and 65 is actuated, at the output 38 there is a first low-value pressure P1 of the regulator 63 for recycling of the component; subsequently, when both the first exchange valve 64 and the second valve 65 are actuated, at the output 38 there is a second pressure value P2 significantly higher than the preceding one, provided by the regulator 61 for rapid metering of the component. Alternatively, when only the valve 61 is actuated, at the outlet 38 there is a pressure value P3, between P1 and P2, for fine and controlled delivery. Thus a so-called "turbo" delivery action is obtained, as a result of which it is possible to supply metered quantities of the individual components in extremely short times, while maintaining a high degree of metering precision, From the above description and illustration it is therefore obvious that it has been possible to provide an apparatus for the delivery and metering of fluid substances to be mixed, particularly but not exclusively suitable for the preparation of dyeing substances to be used in the textile industry, which has a compact structure, in the form of an independent, pre-assembled, movable operating unit provided with all the necessary devices for autonomous operation thereof. Since the various parts of the apparatus are mounted on a single structure provided with wheels, it is obvious that the entire apparatus may be easily transported on-site in a pre-assembled and already fully operational condition, or may be subsequently removed and displaced by simply disconnecting and re-connecting the power connections for the electricity supply, the washing water and the necessary pressurised fluid. Thus, it is possible to obtain an apparatus for the preparation of mixtures of fluid substances, which is extremely compact and has minimum dimensions since it uses a single delivery unit as well as the space on the sides of the conveyor in order to group together the various tanks for storing the substances to be mixed, any pumps or the auxiliary tanks for the supply of the fluid substances to the metering unit itself. With the apparatus according to the invention, therefore, it is possible to obtain major advantages in terms of the space occupied, rapidity of installation and removal, and management, ensuring at the same time a high degree of operational reliability.

What is claimed is:

1. Apparatus for the delivery and metering of fluid substances to be mixed, comprising: a support structure for a plurality of storage tanks for the substances to be mixed, an electronic weighing scale, a plurality of delivery valves and a programmable control unit for selectively connecting the delivery valves to the storage tanks via pumping devices for delivering said substances into mixing containers in a programmed manner; and means for conveying the mixing containers along a conveying path and towards a mixing device, wherein said delivery valves are grouped together in a single delivery unit arranged at one end of said conveyor path which is opposite to the mixing device; the storage tanks being grouped together along at least one side of an intermediate portion of said conveyor path suitable for gathering the mixing containers between the delivery unit and the mixing device; and wherein the delivery unit, the weighing scale, the storage tanks for the substances to be mixed, the pumping devices, the means for conveying the mixing containers, and the mixing device are all provided on a single support frame in the form of a preassembled movable operative unit.

2. Apparatus according to claim 1, wherein said conveying path comprises an independent section located above the weighing scale, and a middle conveying section for gathering the mixing containers along at least part of said path in the region of the storage tanks; said weighing scale and the associated independent section being transversely movable with respect to the conveying path; and actuating means operatively connected to said programmable control unit for laterally moving said scale and said conveying section and for selectively positioning a mixing container located on said conveying section, underneath one or more delivery valves.

3. Apparatus according to claim 2, wherein the weighing scale, the associated section and the actuating means are provided on a vertically movable support shelf, said apparatus further including guiding and actuating means operatively connected to said programmable control unit for moving said support shelf, the scale with the associated section between a lowered position and a raised position with respect to said delivery unit.

4. Apparatus according to claim 1, wherein the support frame includes wheels.

5. Apparatus according to claim 1, wherein said pumping devices comprise a pressurizable auxiliary tank connected to a respective main tank; said apparatus including pneumatic means for supplying pressurized air and for maintaining each auxiliary tank in at least one pressurized condition.

6. Apparatus according to claim 5, wherein said auxiliary tanks include connection means to a pressurized air source via pneumatic valves which are selectively actuated by the programmable control unit.

7. Apparatus according to claim 5, wherein said pneumatic means for supplying pressurized air to the individual auxiliary tanks of the pumping means comprise at least a first and second pressure regulators connected to an inlet side of at least a first and second serially connected pressure exchange valves to provide at least a first and second fluid delivery pressure values to the auxiliary tanks.

8. Apparatus according to claim 7, further comprising a third pressure regulator for providing a third pressure to each auxiliary tank, said third pressure having a value lower than the first and second fluid delivery pressure values, and a recycling circuit for recycling components, between said delivery unit and the individual main tanks, said recycling circuit comprising a recycling valve operatively connected to said programmable control unit.

9. Apparatus according to claim 8, wherein said conveying path comprises independent conveyor sections, which are individually motor driven and located in correspondence of the delivery unit, the intermediate portion for gathering the mixing containers, and the mixing device, respectively.

10. Apparatus according to claim 1, wherein said mixing device is movably supported between an operative position where it extends into a mixing container on said conveyor, and an inoperative position where the mixing device extends into a washing tank.

11. Apparatus according to claim 10, further comprising means for locking the mixing containers on the conveyor path, with respect to said mixing device.

12. Apparatus according to claim 1, wherein said conveying path comprises independent conveyor sections, which are individually motor driven and located in correspondence of the delivery unit, the intermediate portion for gathering the mixing containers, and the mixing device, respectively.

13. Apparatus for the delivery and metering of fluid substances to be mixed, comprising: a support structure for a plurality of storage tanks for the substances to be mixed, an electronic weighing scale, a plurality of delivery valves and a programmable control unit for selectively connecting the delivery valves to the storage tanks via pumping devices for delivering said substances into mixing containers in a programmed manner; and means for conveying the mixing containers along a conveying path and towards a mixing device, wherein said delivery valves are grouped together in a single delivery unit arranged at one end of said conveyor path which is opposite to the mixing device; the storage tanks being grouped together along at least one side of an intermediate portion of said conveyor path suitable for gathering the mixing containers between the delivery unit and the mixing device; said conveying path comprising an independent section located above the weighing scale, and a middle conveying section for gathering the mixing containers along at least part of said path in the region of the storage tanks; said weighing scale and the associated independent section being transversely movable with respect to the conveying path; actuating means operatively connected to said programmable control unit for laterally moving said scale and said conveying section and for selectively positioning a mixing container located on said conveying section, underneath one or more delivery valves, and wherein the delivery unit, the weighing scale, the storage tanks for the substances to be mixed, the pumping devices, the means for conveying the mixing containers, and the mixing device are all provided on a single support frame in the form of a preassembled movable operative unit.

14. Apparatus according to claim 13, wherein the support frame includes wheels.

15. Apparatus according to claim 13, wherein said pumping devices comprise a pressurizable auxiliary tank connected to a respective main tank; said apparatus including pneumatic means for supplying pressurized air and for maintaining each auxiliary tank in at least one pressurized condition.

16. Apparatus according to claim 15, wherein said auxiliary tanks include connection means to a pressurized air source via pneumatic valves which are selectively actuated by the programmable control unit.

17. Apparatus according to claim 15, wherein said pneumatic means for supplying pressurized air to the individual auxiliary tanks of the pumping means comprise at least a first and second pressure regulators connected to an inlet side of at least a first and second serially connected pressure exchange valves to provide at least a first and second fluid delivery pressure values to the auxiliary tanks.

18. Apparatus according to claim 17, further comprising a third pressure regulator for providing a third pressure to each auxiliary tank, said third pressure having a value lower than the first and second fluid delivery pressure values, and a recycling circuit for recycling components, between said delivery unit and the individual main tanks, said recycling circuit comprising a recycling valve operatively connected to said programmable control unit.

19. Apparatus according to claim 13, wherein said mixing device is movably supported between an operative position where it extends into a mixing container on said conveyor, and an inoperative position where the mixing device extends into a washing tank.

20. Apparatus according to claim 19, further comprising means for locking the mixing containers on the conveyor path, with respect to said mixing device.

* * * * *